US011530711B2

(12) United States Patent
Mathis et al.

(10) Patent No.: US 11,530,711 B2
(45) **Date of Patent: *Dec. 20, 2022**

(54) BAFFLE ASSEMBLY FOR MODIFYING TRANSITIONAL FLOW EFFECTS BETWEEN DIFFERENT CAVITIES

(71) Applicant: Selas Heat Technology Company LLC, Streetsboro, OH (US)

(72) Inventors: Steve Mathis, Aurora, OH (US); Chris E. Vandegrift, Milford, OH (US); Guoguang Su, Aurora, OH (US)

(73) Assignee: Selas Heat Technology Company LLC, Streetsboro, OH (US)

( * ) Notice: Subject to any disclaimer, the term of this patent is extended or adjusted under 35 U.S.C. 154(b) by 93 days.

This patent is subject to a terminal disclaimer.

(21) Appl. No.: 16/929,207

(22) Filed: Jul. 15, 2020

(65) Prior Publication Data

US 2020/0340506 A1 Oct. 29, 2020

Related U.S. Application Data

(63) Continuation of application No. 16/012,218, filed on Jun. 19, 2018, now Pat. No. 10,746,207.
(Continued)

(51) Int. Cl.
*F15D 1/02* (2006.01)
*F23D 14/58* (2006.01)
(Continued)

(52) U.S. Cl.
CPC ..... *F15D 1/025* (2013.01); *F15D 1/0005* (2013.01); *F23D 14/586* (2013.01); *F23D 14/70* (2013.01); *F15D 1/02* (2013.01)

(58) Field of Classification Search
CPC ..... F15D 1/025; F15D 1/0005; F15D 1/02; F23D 14/586; F23D 14/70; F23D 14/62
See application file for complete search history.

(56) References Cited

U.S. PATENT DOCUMENTS 1,778,790 A 10/1930 Brandl et al.
1,868,902 A 7/1932 Jackson
(Continued)

FOREIGN PATENT DOCUMENTS

CN 103210220 A 7/2013
CN 105987382 A 10/2016
(Continued)

OTHER PUBLICATIONS

First Examination Report, Indian Patent Application No. 201917052077, pp. 1-6, dated Nov. 10, 2020.
(Continued)

*Primary Examiner* — Alfred Basichas
(74) *Attorney, Agent, or Firm* — Bond, Schoeneck & King, PLLC

(57) ABSTRACT

A baffle assembly and burner including the baffle assembly. The baffle assembly includes a collar having a central axis. A plurality of vanes are secured to the collar. Each vane includes a leg extending from the collar at a first angle with respect to the central axis. The first angle of the leg is configured to impart rotation to a flow of fluid through the baffle assembly. An impingement plate extends from the leg at a second angle with respect to the central axis. The second angle is greater than the first angle.

20 Claims, 3 Drawing Sheets

Related U.S. Application Data

(60) Provisional application No. 62/521,861, filed on Jun. 19, 2017.

(51) Int. Cl.
*F23D 14/70* (2006.01)
*F15D 1/00* (2006.01)

(56) References Cited

U.S. PATENT DOCUMENTS

| | | | | |
|---|---|---|---|---|
| 3,544,290 | A | 12/1970 | Larson, Sr. et al. | |
| 4,255,124 | A | 3/1981 | Baranowski, Jr. | |
| 4,431,403 | A | 2/1984 | Nowak et al. | |
| 4,884,555 | A | 12/1989 | Huang | |
| 5,931,657 | A | 8/1999 | Klouda et al. | |
| 6,042,263 | A | 3/2000 | Mentzer et al. | |
| 10,746,207 | B2 * | 8/2020 | Mathis | F23D 14/70 |
| 2009/0162802 | A1 * | 6/2009 | Strobel | F23D 14/586 431/114 |
| 2013/0340873 | A1 | 12/2013 | Marica | |
| 2015/0167962 | A1 | 6/2015 | Chen | |
| 2016/0252246 | A1 | 9/2016 | Arakawa et al. | |

FOREIGN PATENT DOCUMENTS

| | | | |
|---|---|---|---|
| EP | 2368069 | A1 | 9/2011 |
| EP | 2368069 | B1 | 7/2017 |
| JP | S49-119233 | A | 11/1974 |
| JP | S51-691440 | | 6/1976 |
| JP | S53-69290 | | 1/1978 |
| JP | H6-101815 | A | 4/1994 |
| JP | H8-247421 | A | 9/1996 |
| JP | H11-37422 | A | 2/1999 |
| JP | 2008-089298 | A | 4/2008 |
| KR | 10-0337752 | B1 | 11/2002 |
| WO | 2010073282 | A1 | 7/2010 |

OTHER PUBLICATIONS

International Search Report and the Written Opinion of the International Searching Authority, International Application No. PCT/US2018/038285, pp. 1-12, dated Sep. 10, 2018.
International Preliminary Report on Patentability, International Application No. PCT/US2018/038285, pp. 1-6, dated Dec. 24, 2019.
Notice of Allowance, Japanese Patent Application No. 2020-519024, pp. 1-6, with pp. 1-3 being a translation, dated Dec. 22, 2020.
Notice of Reasons for Refusal, Japanese Patent Application No. 2021-015754, pp. 1-5, with pp. 1-3 being a translation, dated Aug. 27, 2021.
First Office Action, Canadian Patent Application No. 3,066,935, pp. 1-4, dated Aug. 11, 2021.
Notification of Reason for Refusal, Korean Patent Application No. 10-2019-7038969, pp. 1-8, with pp. 1-4 being a translation,dated May 3, 2021.
Supplementary European Search Report, European Patent Application No. 18819871.7, pp. 1-6, dated Feb. 1, 2021.
First Office Action, Chinese Patent Application No. 201880041336.9, pp. 1-17 with pp. 1-9 being a translation, dated Apr. 6, 2021.
Second Office Action, Chinese Patent Application No. 201880041336.9, pp. 1-13, with pp. 1-7 being a translation, dated Nov. 3, 2021.
Notification of Reason for Refusal, Korean Patent Application No. 10-2019-7038969, pp. 1-11, with pp. 1-6 being a translation, dated Dec. 21, 2021.
Korean Notice of Final Rejection for Korean Application No. 10-2019-7038969, dated Jun. 28, 2022, pp. 1-12 with pp. 7-12 being the translation.
Written Opinion, Brazilian Patent Application No. BR112019026849, dated Sep. 7, 2022, pp. 1-6 with pp. 1-2 being a translation of relevant portions.
Second Office Action, Canadian Patent Application No. 3,066,935, dated Sep. 21, 2022, pp. 1-4.
Examination Report, European Patent Application No. 18819871.7, dated Aug. 16, 2022, pp. 1-3.

* cited by examiner

BAFFLE ASSEMBLY FOR MODIFYING TRANSITIONAL FLOW EFFECTS BETWEEN DIFFERENT CAVITIES

CROSS-REFERENCE TO RELATED APPLICATIONS

This application is a Continuation of U.S. patent application Ser. No. 16/012,218, filed on Jun. 19, 2018, entitled "BAFFLE ASSEMBLY FOR MODIFYING TRANSITIONAL FLOW EFFECTS BETWEEN DIFFERENT CAVITIES" which claims the benefit of U.S. Provisional Patent Application Ser. No. 62/521,861, filed on Jun. 19, 2017, entitled "BURNER BAFFLE FOR IMPROVING FLAME UNIFORMITY", the disclosures of which are incorporated herein by reference in their entireties.

FIELD OF THE INVENTION

The present disclosure relates generally to a baffle assembly, and more specifically, to a baffle assembly to modify the effects on fluid flow while transitioning between different cavities, which can be utilized in a variety of industries including gas burners.

BACKGROUND

A variety of tools, systems, and assemblies require the supply of fluid or gaseous mixtures. For example, gas burners are utilized to generate a flame to heat a product using a gaseous fuel such as acetylene, natural gas, and/or propane, among other fuel sources. e.g., air-gas mixtures may be utilized as fuel for gas powered burners. In gas burners and other applications, the fluid may transition between different cavities, e.g., between conduits or pipes of different sizes, between a storage tank or area and a conduit or pipe, through a restriction or inlet, etc. Per fluid dynamic principles, it is generally known that transitioning between different cavities, e.g., differently sized cavities, can affect the pressure, velocity, and other characteristics of the fluid flow, which are herein referred to as entrance effects or transitional effects. Additionally, the flow may experience entrance effects along an "entrance length" proximate to the transition, with the flow stabilizing at some distance distal from the transition. Referring back to gas burners (particularly ribbon burners that are arranged to produce a flame along a length of the burner), the entrance effects introduced by the transition from the fuel inlet into the burner cavity can create an issue in which the properties of the produced flame proximate to the fuel inlet differ from the properties of the flame at distances further away from the fuel inlet.

Accordingly, there is a need in the art for an assembly for modifying the entrance and/or transitional effects of fluid flows in a reduced distance, such as for improving the operation of gas burners and other systems.

SUMMARY OF THE INVENTION

The present disclosure is directed to a baffle assembly for modifying the entrance and/or transitional effects of fluid flows, such as for improving the operation of gas burners and other systems.

An advantage of an embodiment of the baffle assembly described herein is that it is compact in length and is easily replaceable. Another advantage is that it is easily assembled. A further advantage is that it improves flame uniformity when used with a burner, such as a ribbon burner.

Generally, in one aspect, there is provided a baffle assembly. The baffle assembly includes a collar having a central axis; and a plurality of vanes secured to the collar, each vane comprising: a leg extending from the collar at a first angle with respect to the central axis, the first angle of the leg configured to impart rotation to a flow of fluid through the baffle assembly; and an impingement plate extending from the leg at a second angle with respect to the central axis, wherein the second angle is greater than the first angle.

In one embodiment, the second angle is defined as the first angle subtracted from a third angle measured between the leg and the impingement plate. In one embodiment, the first angle is between 5° and 30°. In one embodiment, the second angle is between 60° and 120°. In one embodiment, the impingement plates have a width and a length sufficient to block at least 80% of a flow area through the collar.

In one embodiment, a length of the leg is approximately equal to a diameter of the collar. In one embodiment, a first length of each impingement plate is equal to between about 25% to 50% of a second length of the leg. In one embodiment, the baffle assembly includes four of the vanes equally spaced about the inner surface of the collar. In one embodiment, the collar has a circular cross-sectional shape.

Generally, in one aspect, a burner assembly includes an inlet and the baffle assembly of claim 1 installed in, at, or proximate to the inlet. In one embodiment, the burner assembly is a ribbon burner. In one embodiment, the inlet includes a first inlet and a second inlet positioned at opposite sides of a burner body.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from the embodiments described below.

BRIEF DESCRIPTION OF THE DRAWINGS

The foregoing will be apparent from the following more particular description of example embodiments of the present disclosure, as illustrated in the accompanying drawings in which like reference characters refer to the same parts throughout the different views. The drawings are not necessarily to scale, emphasis instead being placed upon illustrating embodiments of the present disclosure.

DETAILED DESCRIPTION OF EMBODIMENTS

A description of example embodiments of the invention follows.

Figure 1:
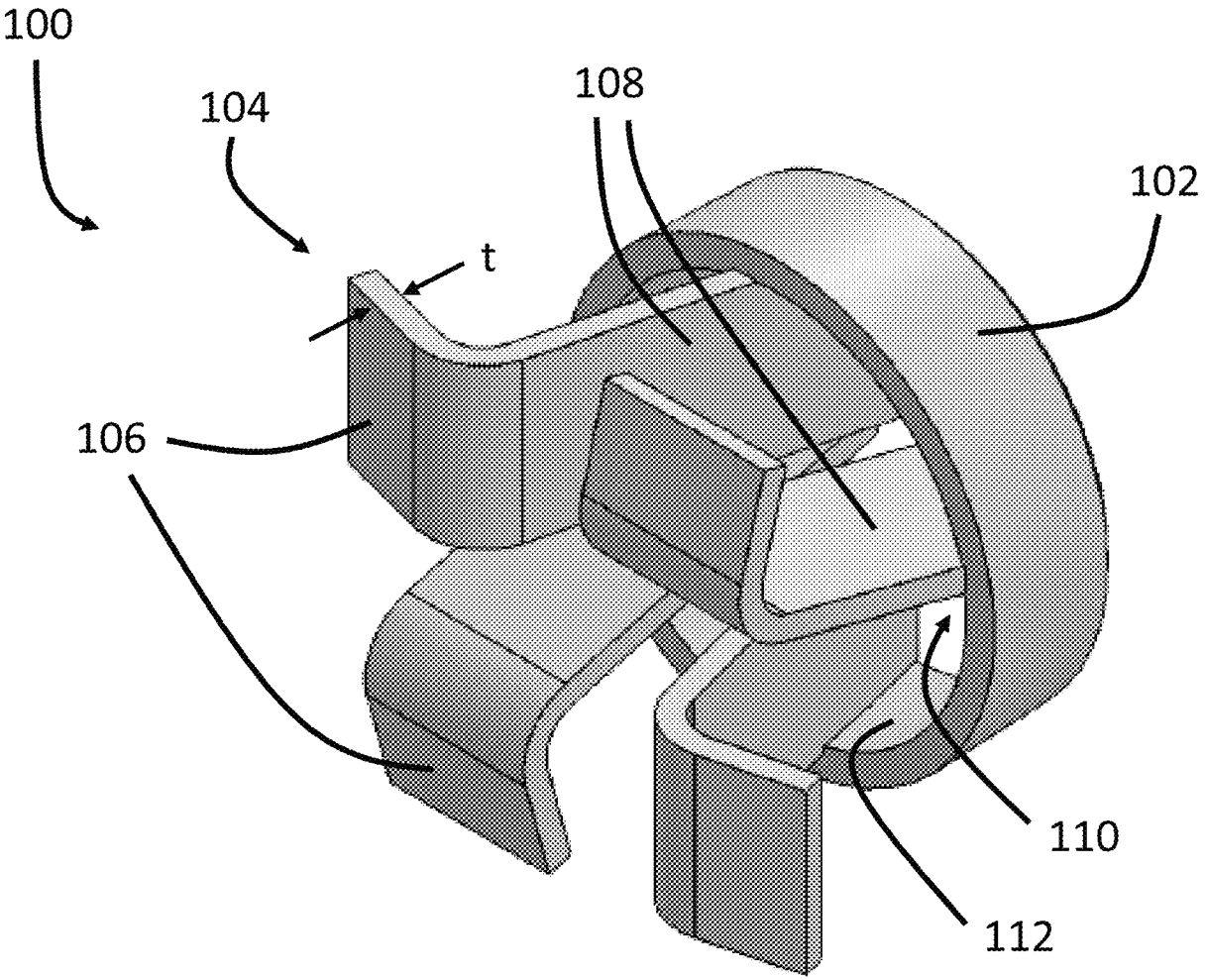
FIG. 1 is a perspective view of a baffle assembly, in accordance with an example embodiment of the present disclosure.
Figure 2B:
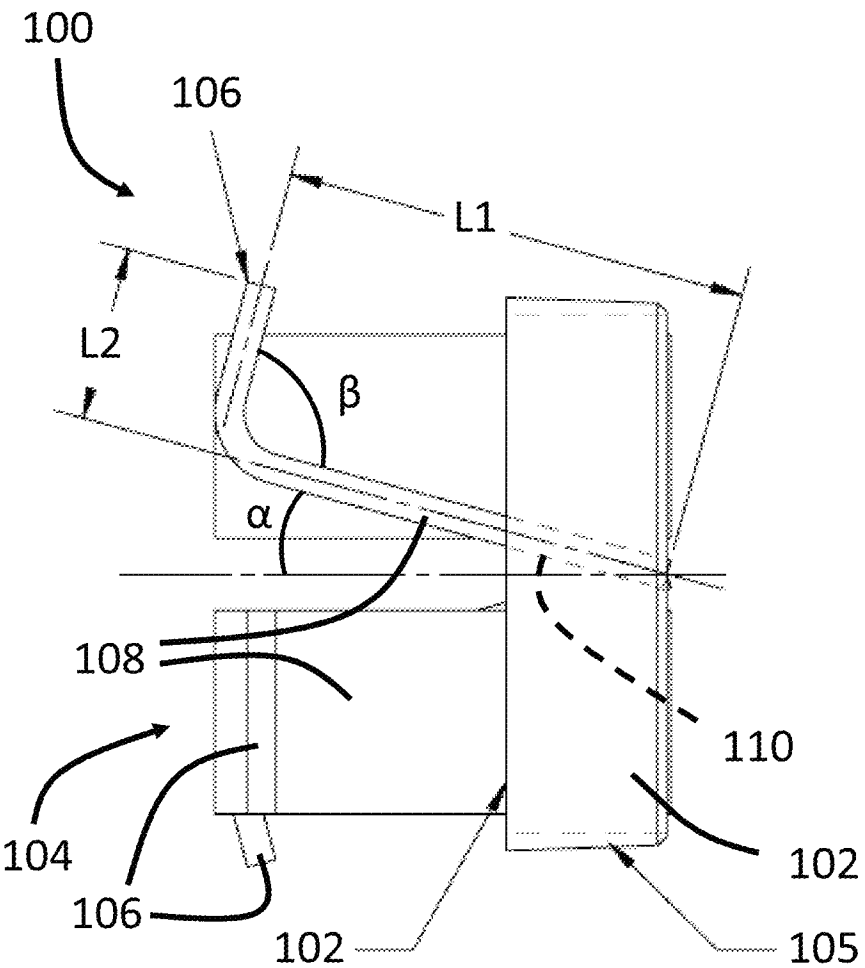
FIG. 2B is a side view of the assembly of the baffle assembly of FIG. 1, in accordance with an example embodiment of the present disclosure.
Figure 2A:
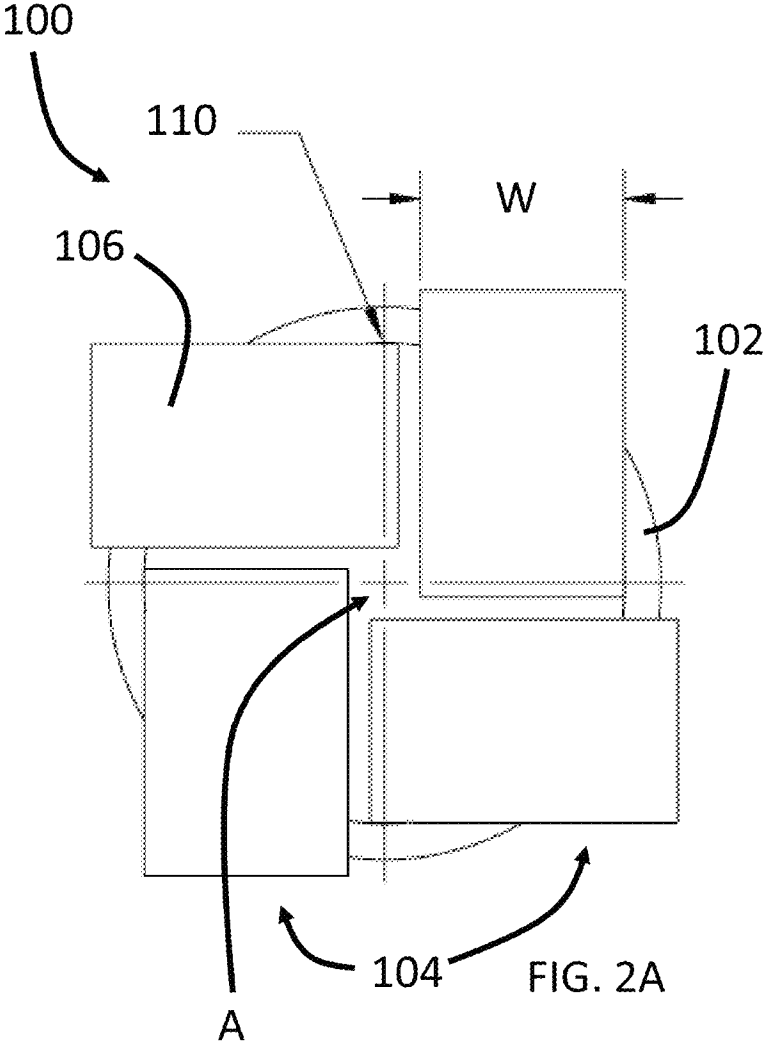
FIG. 2A is a front view of the assembly of the baffle assembly of FIG. 1, in accordance with an example embodiment of the present disclosure.

A perspective view of a baffle assembly is shown in FIG. 1, in accordance with an embodiment. FIGS. 2A and 2B are respective front and side views of the assembly of the baffle assembly of FIG. 1. The following should be viewed based on FIGS. 1-2B.

The baffle assembly 100 generally includes a hub or collar 102 having a plurality of vanes 104 secured thereto. As discussed in more detail below, the vanes 104 of the baffle assembly 100 are arranged to reduce entrance effects and/or transitional effects on the fluid flow as the flow of a fluid transitions between different sized, shaped, structured, and/or oriented flow cavities. For example, the baffle assembly 100 may be positioned at, in, or near the transition of a pipe or cavity having a relatively larger cross-sectional flow area into a pipe or cavity having a relatively smaller cross-sectional flow area. Namely, the baffle assembly 100 can be used to create a more even cross-sectional distribution of fluid flow. Additionally, the baffle assembly 100 can be useful to decrease the velocity of the fluid flow, thereby corresponding to a relative increase in fluid pressure, which can be advantageous in a number of applications. In accordance with the embodiments disclosed herein, those of ordinary skill in the art will recognize transitions between other fluid flow cavities that may result in undesirable entrance and/or transitional effects that can be alleviated by the baffle assembly 100.

The collar 102 may be or comprise a short pipe nipple, e.g., having threads 105 (shown schematically only with broken lines to indicate approximate thread dimensions) for threaded engagement in, with, or between one or more pipes, conduits, bushings, cavities, etc. In this way, as discussed herein, the baffle assembly 100 can be positioned at or near the interface or transition between two different fluid flow cavities. For example, as shown in FIG. 2B, the threads 105 may be in accordance with any desired specification or standard, such as the National Pipe Thread Taper (NPT) standards.

In the illustrated embodiment, the collar 102 is shown having a substantially circular cross-sectional shape, although it is to be appreciated that other shapes can be utilized depending on the particular system in which the baffle assembly 100 is installed. For example, if a press fit, adhesives, fasteners, or some other fastening means or mechanism is utilized instead of the threads 105, then other shapes such as rectangular, triangular, polygonal, etc. may be used.

In the illustrated embodiment, each vane 104 includes an impingement plate 106 and a leg 108. As illustrated, the baffle assembly 100 includes four of the vanes 104 equally spaced about and secured at an area 110 to an inner surface 112 of the collar 102, although other numbers of vanes may be utilized. The connection between the vanes 104 and the collar 102 at the area 110 may include or be defined by welds, e.g., tack welds, or any other manner. For example, a groove just smaller than a thickness t of the legs 108 can be cut into the inner surface 112 and the legs 108 press fit into the grooves. Those of ordinary skill in the art will appreciate other means of securement, e.g., adhesives, clips, fasteners, etc.

The legs 108 extend from the collar 102 at an angle $\alpha$ with respect to a central axis A, while the impingement plate 106 is bent at an angle $\beta$ with respect to the leg 108. Accordingly, it is to be appreciated that the impingement plates 106 are arranged with respect to the central axis A at an angle equal to $(\beta-\alpha)$. By use of multiple circumferentially spaced vanes 104, each having one of the legs 108 at the angle $\alpha$, the legs 108 can induce or promote a spiraling, rotation, or spinning of the fluid flow as it passes through the baffle assembly 100. That is, fluid flow reaching the baffle assembly 100 (e.g., generally flowing parallel to the axis A through a pipe or other cavity) will first pass through the collar 102 and then encounter the legs 108. Due to the angled orientation of the legs 108, the fluid flow is urged out of alignment with the central axis A. That is, each respective portion of the fluid flowing through the baffle assembly 100 is directed at the angle $\alpha$ away from the central axis A.

It is noted that each of the legs 108 is arranged to urge the fluid flow in a different direction relative to the central axis A (although each direction is at least partially radially outwardly directed). This promotes the aforementioned spiraling or rotation of the fluid flow. In one embodiment, the angle $\alpha$ is between about 5° and 30° or more particularly between about 10° and 20°. Advantageously, these ranges of angles promote rotational or spiraling in the flow while remaining substantially axially aligned with central axis A.

As the fluid flow continues, it next encounters the impingement plates 106, which are substantially perpendicular and/or transverse to the central axis A. For example, the angle $\beta$ may be approximately equal to 90°, and/or the value of $\beta-\alpha$ (i.e., the angle of the impingement plates 106 with respect to the central axis A) may be approximately equal to 90°, e.g., between about 120° and 60°. In this way, fluid flow encountering the impingement plates 106 is much more sharply urged in a substantially radial direction (i.e., perpendicular to the central axis A). Additionally, since the impingement plates 106 are substantially perpendicular and/or transverse to the central axis A, the velocity of the flow encountering the impingement plates 106 is significantly reduced, as the flow is redirected from the axial direction to the radial direction.

Advantageously in many applications, a reduction in velocity is accompanied by an increase in pressure and a shorter entrance length (along which entrance length the flow is subjected to entrance or transitional effects before stabilizing). Together with the spiraling or rotation imparted by the legs 108 discussed above, uniformity in the distribution of the flow (e.g., mixing of the flow) is maintained while the velocity is decreased, the pressure is increased, and/or the entrance length is decreased.

The vanes 104 can be made of any suitable material, for example, mild steel or resilient plastic. The dimensions of the vanes 104 may be set to facilitate the above-described or other functionalities. For example, the legs 108 may have a length L1 that is suitable for imparting a sufficient amount of spiraling to the flow of fluid. The length L1 may be influenced by the size of the collar 102, the change in dimensions or structure of the flow cavities on opposite sides of the baffle assembly 100, the viscosity, velocity, pressure, or other properties of the flow of fluid, etc. In one embodiment, the length L1 of the legs 108 is approximately equal to the diameter of the collar 102, e.g., 2" in one embodiment.

The impingement plates 106 likewise have a length L2, which can be set to facilitate the redirection of the flow from a substantially axial direction (i.e., parallel to the axis A) to a substantially perpendicular direction (i.e., perpendicular to the axis A). In one embodiment, the length L2 is approximately 25-50% of the length L1 and/or of the diameter of the collar 102. For example, in one embodiment, the length L2 may be ¾" and the length L1 and/or the diameter of the collar 102 may be 2".

Additionally, the impingement plates 106 may have a width W to assist in the aforementioned functionality. The width W can be set so that it assists in suitably blocking or impeding the flow of fluid to a desired level. For example, smaller values of the width W could be used to impede the flow of fluid to a lesser degree, thereby decreasing the velocity and/or increasing the pressure to a lesser degree than if a larger value were used for the width W. In one embodiment, the length L2 and the width W are set to block at least the majority of the flow area through the collar 102. For example, as shown in FIG. 2A, the impingement plates 106 block substantially all of the flow area through the collar 102 with the exception of a small portion near the central axis A and the small portions between each adjacent set of the impingement plates 106. In one embodiment, the impingement plates 106 are dimensioned to block at least about 75% of the flow area of the collar 102.

Figure 3:
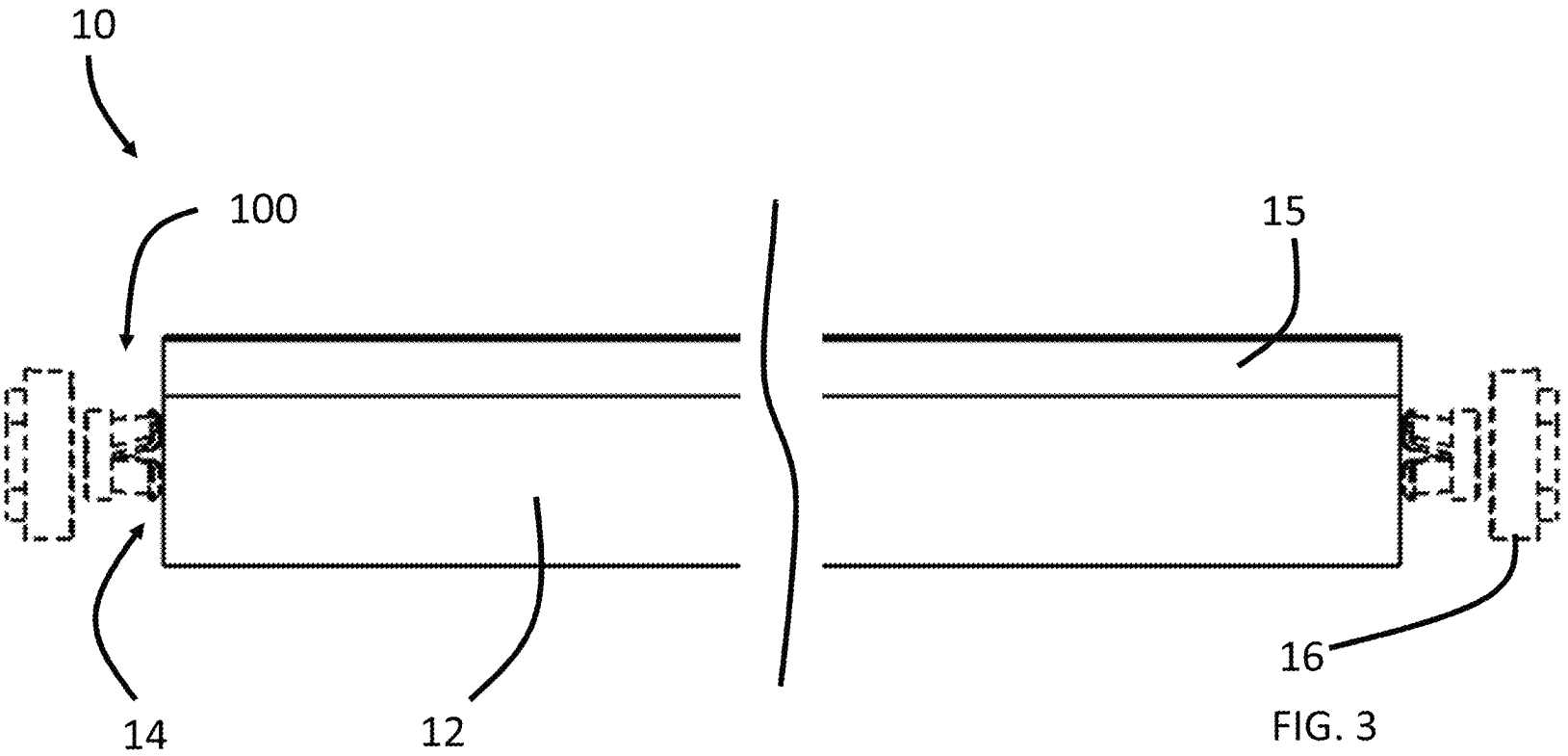
FIG. 3 is a schematic side view of the baffle assembly of FIG. 1 installed on each end of a ribbon burner, in accordance with an example embodiment of the present disclosure.

FIG. 3 illustrates one use for the baffle assembly 100. More particularly, FIG. 3 shows a ribbon burner 10 having the baffle assembly 100. The ribbon burner 10 may take the form of an ERB QuadCool Ribbon Burner commercially available from Selas Heat Technology Company. The ribbon burner 10 includes a burner body 12, e.g., which defines a cavity for receiving fluid flow (e.g., gas/air mixture or other gaseous fuel) at one or more inlets 14, e.g., which may be positioned at one or both opposite axial ends of the burner body 12. A ribbon pack 15 may be included to produce a flame substantially along its entire length (e.g., a "sheet flame") by use of the fuel mixture that is injected into the burner body 12 via the inlet(s) 14.

The baffle assembly 100 can be secured in or along a fuel supply conduit, e.g., a pipe, between the gas/air mixture source and the inlet 14 and/or the inside of the burner body 12. For example, a bushing 16 of a fuel supply line is illustrated in FIG. 3, into which the baffle assembly 100 can be inserted. For example, the bushing 16 may include threading (e.g., female threading) corresponding to the threads 105 and/or be otherwise arranged to receive the collar 102 of the baffle assembly 100 therein.

As discussed above, the flow cavities on opposite sides of the inlet 14 (e.g., the inside of the burner body 12 with respect to the fuel supply line) may be dissimilar such that the fluid flow is subjected to entrance and/or transitional effects as it transitions through the inlet 14. For example, the inlet 14 may be or include a relatively restricted flow area with respect to the flow area through the supply line, e.g., the bushing 16. In this way, absent the baffle assembly 100, the velocity of the fluid would tend to increase and the pressure decrease as the fluid enters the burner body 12. As a result of the decreased pressure and/or other entrance effects, the flame produced by the ribbon burner 10 proximate to the inlet 14 may be less developed than the flame produced by the burner 10 at locations distal to the inlet, e.g., toward the center of the burner 10. Advantageously, as discussed above, positioning the baffle assembly 100 at, near, or in the inlet 14 can reduce the entrance length of the entrance and/or transitional effects, decrease the velocity, and/or increase the pressure of the fluid as it enters the burner body, thereby producing a more even and uniform flame from the burner 10 across its entire length. Those of ordinary skill in the art will recognize that the ribbon burner 10 is just one example and that the baffle assembly 100 can be used in other embodiments.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A baffle assembly, comprising:

a collar having a central axis; and, a plurality of vanes secured to the collar, each vane comprising:

a leg extending from the collar at a first angle with respect to the central axis, the first angle of the leg configured to impart rotation to a flow of fluid through the baffle assembly, wherein the flow of fluid is directed from the collar to the plurality of vanes between differing flow cavities; and an impingement plate extending from the leg at a second angle with respect to the central axis, wherein the second angle is greater than the first angle, and wherein the impingement plate is configured to reduce a velocity of the flow of fluid and an entrance length proximate to a transition between the differing flow cavities.

2. The baffle assembly of claim 1, wherein the second angle is defined as the first angle subtracted from a third angle measured between the leg and the impingement plate.

3. The baffle assembly of claim 1, wherein the first angle is between 5° and 30°.

4. The baffle assembly of claim 1, wherein the second angle is between 60° and 120°.

5. The baffle assembly of claim 1, wherein the impingement plate has a width and a length sufficient to block at least 80% of a flow area through the collar.

6. The baffle assembly of claim 1, wherein a length of the leg is approximately equal to a diameter of the collar.

7. The baffle assembly of claim 1, wherein a length of the impingement plate is equal to between about 25% to 50% of a length of the leg.

8. The baffle assembly of claim 1, wherein the plurality of vanes comprises first and second legs configured to urge the flow of fluid in first and second directions that are different from each other, wherein the first and second directions are relative to the central axis.

9. The baffle assembly of claim 1, wherein the collar has a circular cross-sectional shape.

10. The baffle assembly of claim 1, wherein the impingement plate is further configured to increase a pressure of the flow of fluid.

11. The baffle assembly of claim 1, wherein the flow of fluid is directed from a first flow cavity to a second flow cavity of the differing flow cavities and the first flow cavity is larger than the second flow cavity.

12. A burner assembly, comprising:

a first inlet;

dissimilar flow cavities on opposite sides of the first inlet; and a baffle assembly installed in, at, or proximate to the first inlet, the baffle assembly comprising:

a collar having a central axis; and a plurality of vanes secured to the collar, each vane of the plurality of vanes comprising:

a leg extending from the collar at a first angle with respect to the central axis, the first angle of the leg configured to impart rotation to a flow of fluid through the baffle assembly; and an impingement plate extending from the leg at a second angle with respect to the central axis, wherein the second angle is greater than the first angle.

13. The burner assembly of claim 12, further comprising a ribbon burner.

14. The burner assembly of claim 13, further comprising a ribbon pack to produce a flame substantially along its length.

15. The burner assembly of claim 12, further comprising a burner body defining a cavity for receiving the flow of fluid at the first inlet.

16. The burner assembly of claim 15, further comprising a second inlet, wherein the first inlet is positioned at a first axial end of the burner body and the second inlet is positioned at a second axial end of the burner body, and wherein the first axial end of the burner body is opposite the second axial end of the burner body.

17. The burner assembly of claim 12, wherein the flow of fluid is directed through the baffle assembly from the collar to the plurality of vanes.

18. The burner assembly of claim 12, wherein the impingement plate is configured to reduce a velocity of the flow of fluid and an entrance length proximate to a transition between the dissimilar flow cavities.

19. The burner assembly of claim 12, wherein the dissimilar flow cavities comprise a first cavity having a first cross-sectional flow area and a second cavity having a second cross-sectional flow area, wherein the second cross-sectional flow area is different than the first cross-sectional flow area.

20. The burner assembly of claim 12, wherein the first angle is between 5° and 30° or the second angle is between 60° and 120°.

* * * * *